US005231455A

United States Patent [19]

Day

[11] Patent Number: 5,231,455

[45] Date of Patent: Jul. 27, 1993

[54] AIR JET CLEANER FOR ONE PUMP COLOR IMAGER

[75] Inventor: Gene F. Day, Hillsborough, Calif.

[73] Assignee: Phoenix Precision Graphics, Inc., Sunnyvale, Calif.

[21] Appl. No.: 930,779

[22] Filed: Aug. 17, 1992

[51] Int. Cl.[5] ..... G03G 15/10

[52] U.S. Cl. ..... 355/256; 118/645; 118/660; 346/157

[58] Field of Search ..... 355/256-258, 355/326, 327; 118/645, 659-662; 346/157

[56] References Cited

U.S. PATENT DOCUMENTS 4,569,584 2/1986 St. John et al. ..... 355/244
4,987,429 1/1991 Finley et al. ..... 346/157

FOREIGN PATENT DOCUMENTS 1-185569 7/1989 Japan ..... 355/256
3-33778 2/1991 Japan ..... 355/256

*Primary Examiner*—Joan H. Pendegrass
*Attorney, Agent, or Firm*—Schneck & McHugh

[57] ABSTRACT

An electrostatic color printer or copier which uses a single pump for controlling fluid toner at low flow velocities and a separate pump or blower for an air jet used to expel fluid from common passages between applications of different colors. A full width toning applicator admits toner and air in a manner so that air limits flow of toner beyond the applicator. During a purging cycle, more air is admitted, forming an air jet which blasts surfaces and passages clear of liquid.

14 Claims, 3 Drawing Sheets

AIR JET CLEANER FOR ONE PUMP COLOR IMAGER

TECHNICAL FIELD

The invention relates to color printing and in particular to electrostatic color printing and copying.

BACKGROUND ART

In U.S. Pat. No. 4,987,429 to R.B. Finley, G.F. Day and D.J. Devine there is a description of problems encountered in electrostatic printing of the kind employing liquid toners. There has been an evolution in electrostatic color printing technology from the use of multiple toner applicators, i.e. one per color, to a system in which a single shared applicator is employed, residual toner being cleaned from the applicator after each color pass. The benefits of this approach are that residual toner no longer dries out, which necessitates manual cleaning of the applicator, and the number of components in such a printing system is reduced. The patent to Finley et al. describes the problems which occur with a liquid toning system which uses a single applicator for multiple toner colors. Since several colored liquids share the same volume of tubing, piping, and applicator and the like, some color cross-mixing is inevitable and this results in poor imaging and the loss of color saturation as well as in premature toner disposal. Liquid toner disposal is costly for the user. The replacement cost is high for colored liquid toners and the expense for proper disposal of the spent liquids is escalating because of government agency regulations.

The patent to Finley et al. teaches an improvement in single applicator color printing by means of a single pump for all colors with a selector valve selectively connecting the pump input to one of the various colored toners, to wash fluid, or to room air. By the use of the "liquid" pump, with its input connected to room air, for the purpose of liquid purging with air, most of the liquid can be expelled prior to the introduction of the next selected liquid. This reduces the effective "common volume" which is shared by all the liquids and permits a single pump to be shared by all colors without excessive color cross contamination. The patent also teaches the use of a small toning applicator or shoe which scans a drum-supported sheet in a helical pattern. While the contribution of Finley et al. is significant, a problem which is inherent in helical scan systems is that of visible image banding in which the boundaries of the helical stripes are visible. For this reason, most electrostatic printers use a full-width toning applicator so that there are no toning boundaries within the image. Increasing demand for pictorial type imaging as opposed to line drawings is accelerating the need for highly uniform imaging and toning characteristics.

One might then attempt to adapt the one-pump approach of Finley et al. to full width applicator systems. For example, in large format web-based printers manufactured by Xerox Corporation, as described in U.S. Pat. No. 4,569,584 to St. John et al., an electrostatic printing system applies color toners successively by moving a web back and forth past multiple toner applicators, with the position of the web carefully controlled by optical registration marks along the edges of the web. Could the one-pump system of Finley et al. be adapted to the web system of St. John et al., with the multiple toning stations of St. John et al. replaced with a single full-width toning shoe? The answer is not clear because, even if this modification could be done, the purging system uses a toner pump with a characteristically low volume flow rate for liquids and this results in very slow moving purge air. Such slow-moving air is only partly effective in expelling liquids from the tubing, pipes and applicator and the like so that a significant volume of liquid residual remains even after lengthy air purging. While this may suffice for a small scanned toning shoe-based system, the full-width system of St. John et al. is many times larger and the residual liquid remaining even after air purging results in poor image quality and early toner disposal. What is needed is a more effective method of expelling the residual liquids from the common volume, including the liquid pump itself. The difficulty arises basically because of the extreme differences between the fluid properties of toner and air. Air is about 54 times less viscous and 630 times less dense than toner or wash fluid. For this reason, pumps which are effective at moving toner fluid are extremely ineffective at the task of moving air and vice-versa.

An object of the invention is to devise an electrostatic printing system which has the high-speed and image uniformity advantages of web-based systems while preserving multiple benefits of a single applicator, one-pump system.

SUMMARY OF INVENTION

The above object has been met with an electrostatic color printer in which a single pump is used for liquid toner supply and washing, but air purging of the common volume is no longer driven by the single pump. A high velocity air blower is connected to the liquid common volume. Now optimized toner flow rates and a high air velocity for purging can be maintained independently. The increase in common volume to accommodate the air blower is limited by introducing valves which bring the blower into the system only when air purging is desired. The mixture of air and liquid which emerges from the common volume during purging is directed back to the corresponding liquid supply tank which serves to separate the air from the liquid. The air is then returned to the blower inlet port by way of a common air manifold which connects the air spaces above each of the liquids in its respective tank.

A full-width toner applicator is employed in a web-based electrographic printer in which the toning is done while moving the web across the exposed top of the applicator. During web re-wind in preparation for the next toning pass the residual toner in the common volume is purged with high velocity air and returned to the corresponding toner tank, then the common volume is thoroughly washed using wash fluid. Finally, the wash fluid is also purged with high velocity air and returned to the wash fluid tank preparatory to introduction of a subsequent toner color into the common volume. In this way the multiple benefits of a single full-width applicator and a single toner pump are attained.

An advantage of the present invention is that high speed, uniform toning is possible with a single full width toning applicator, yet each the excess amount of each color of toner is collected and returned to a supply vessel, with the common volume being blasted clear of toner in a short time with the high velocity air blower.

BEST MODE FOR CARRYING OUT THE INVENTION

Figure 1:
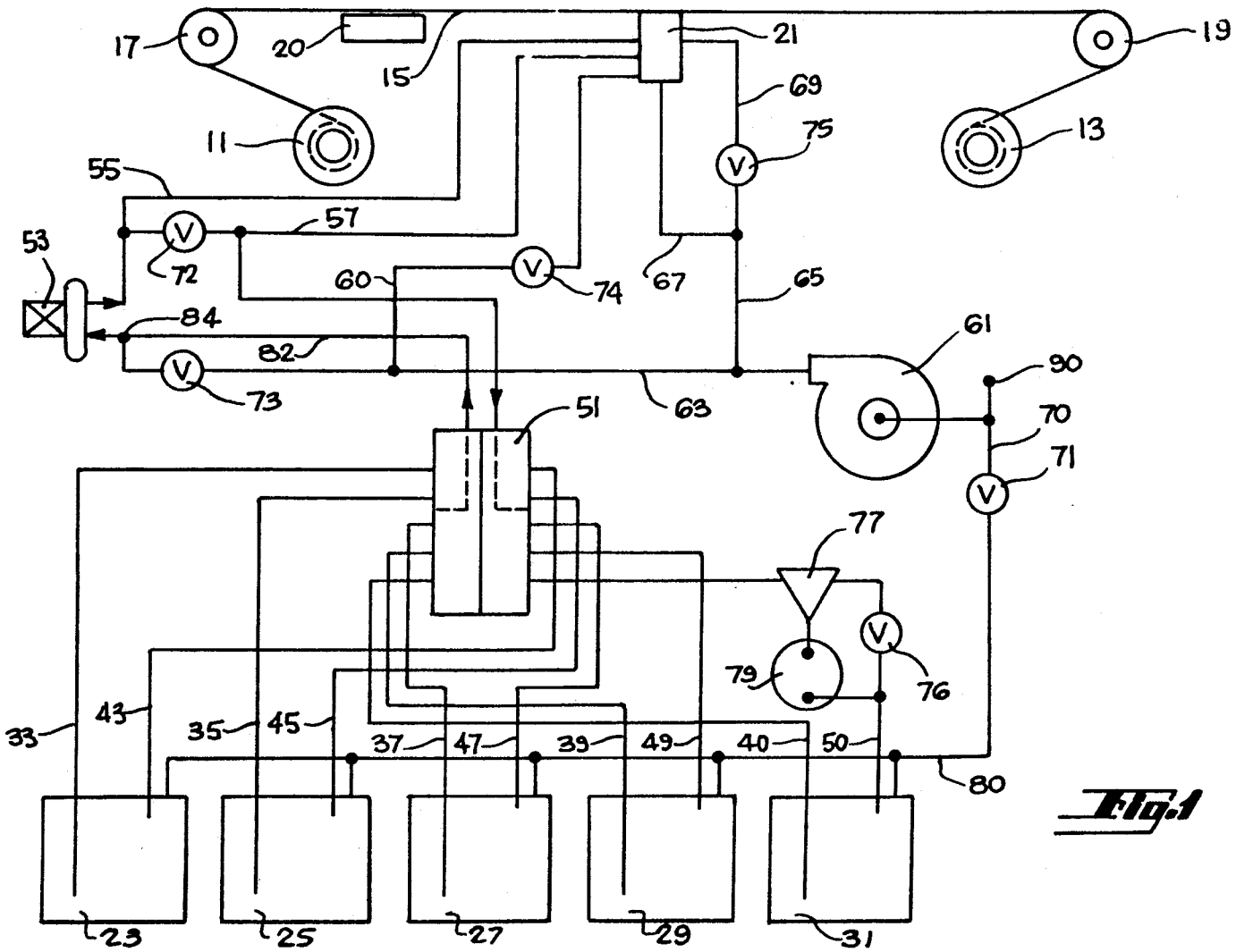
FIG. 1 is a plan view of an air jet cleaner system of the present invention employed in a web fed electrostatic imager.

With reference to FIG. 1, a paper supply roller 11 is spaced apart from a take-up roller 13 with a web of paper 15 maintained in tension between the rollers, using idlers, including the paper-turning idlers 17 and 19. The supply and take-up rollers are powered by servo controlled motors, not shown, which can accurately position the paper. This is necessary in color printing since multiple passes of the paper past writing head 20 and toner applicator 21 is required, one pass for each color. These multiple passes of the paper require back and forth motion of the paper until all writing and toning is complete. The writing head must be in accurate registration with corresponding locations on each pass of the paper. This is accomplished by careful monitoring of the paper position, for example, as described in U.S. Pat. No. 4,569,584 to St. John et al. In the present invention, toning occurs only while the web moves in one direction, while purging and cleaning occur while the web is reset, moving in the opposite direction. This is not necessary, since the system could be stopped for purging and cleaning, but it is an efficient use of the reset interval. The reset interval could also be used for bidirectional writing as described below.

Figure 2:
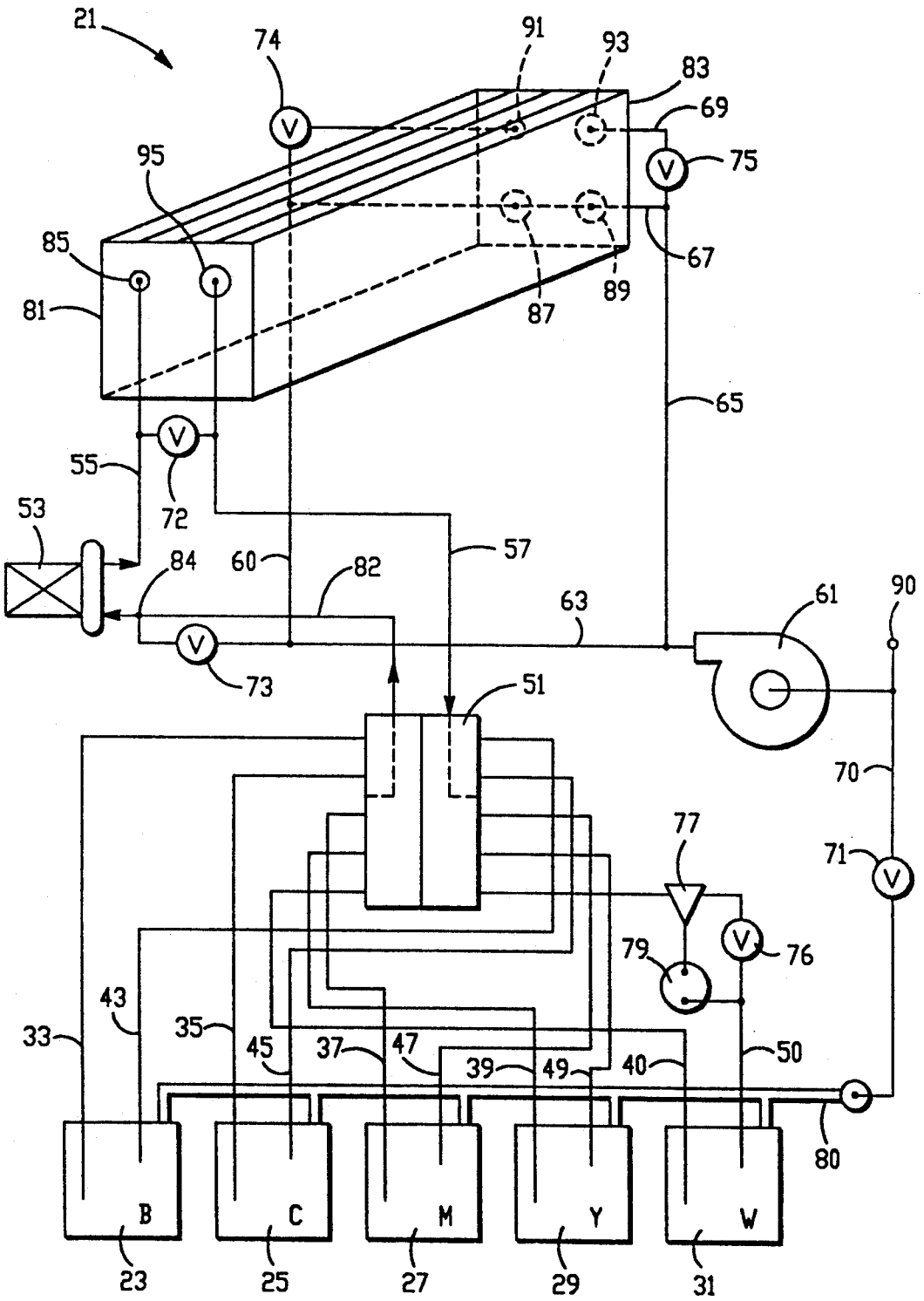
FIG. 2 is a piping plan for the toner head shown in FIG. 1.

With reference to both FIGS. 1 and 2, the toner applicator 21 is a full width toning shoe which spans the width of the paper. Liquid toner is supplied to the applicator and flows across the entirety of an exposed upper applicator surface allowing toner particles to adhere to charged regions of the paper. The electrostatic writing head 20 is located upstream from the toner applicator, as shown in FIG. 1. The head is a scanning head which moves across the width of the paper, similar to scanning heads of dot matrix printers. However, instead of applying ink to paper by means of a ribbon, the head, having an array of closely spaced wires connected to a high voltage supply, merely deposits an electrostatic charge in an analogous manner, thereby writing a latent image. Two writing heads may be used, one on either side of the toner applicator, located in corresponding locations so that the paper may be written upon while moving in either direction. Liquid toner in the applicator includes charged particles in suspension which adhere to oppositely charged small regions of the latent image. Excess toner is removed after the latent image has been developed by the application of toner and then another pass is made where the next color is written, until all colors have been written in the same way to form a fully developed image. Between passes the air jet cleaner of the present invention is used to purge toner from passages to be shared with the next color. Wash fluid is then introduced in order to dissolve any residual toner so as to leave the passages in a clean condition. Jet air is then reintroduced to purge the wash fluid so as to prepare the passages for the next color.

Toner is supplied by a plurality of toner supply vessels including a vessel 23 for black, a vessel 25 for cyan, a vessel 27 for magenta and a vessel 29 for yellow. A fifth vessel 31 is used to contain wash fluid, such as isopar. Vessel 23 includes a supply line 33 and a return line 43. Vessel 25 includes a supply line 35 and a return line 45. Vessel 27 has a supply line 37 and a return line 47. Vessel 29 has a supply line 39 and a return line 49. Vessel 31, supplying wash fluid, has a supply line 40 and a return line 50. All of the aforementioned supply and return lines are connected to a selector valve 51 which allows one of the supply vessels to communicate with the toner applicator 21 at one time. At different times, each of the other vessels may be brought into communication with the toner applicator.

The toner supply path 82 from selector valve 51 to toner applicator 21 involves a common passageway using a small diameter hose of approximately one quarter inch inside diameter leading to the single pump 53. From pump 53 a similar hose of small diameter 55 is connected to toner applicator 21 forming a supply path. A toner return path is provided by hose 57 which joins the toner applicator 21 to selector valve 51 without passing through the pump.

A high velocity air supply means, such as blower 61 provides an air jet in a conduit 63 of large inside diameter, approximately five-eighths inch, joining the air supply means to liquid pump 53. Air blower 61 is preferably an RDC Revaflow Blower Model RDC12HH, manufactured by EG&G Rotron; Saugerties, N.Y. Another conduit 65, similar to conduit 63, is connected from the air supply means 61 to the toner applicator 21 through first and second conduit branches 67 and 69. Second branch 69 includes air valve 75 which is opened for air jet purging of applicator 21. Another air conduit 60 connects conduit 63 to applicator 21 through air valve 74 which is used for air jet purging of a different part of applicator 21. Air valves 74 and 75 are thus opened in order to thoroughly purge and expel liquid from separate internal passages of applicator 21. Air valves 74 and 75 may be opened for air jet purging simultaneously or they may be opened sequentially. Sequential opening provides maximum air flow through a selected internal passage of applicator 21.

Air return line 70 connects the input of air supply means 61 to common air collection manifold 80 through air valve 71. Liquid toner return lines 43, 45, 47, and 49 and wash fluid return line 50 carry a mixture of liquid and air to selected tank 23, 25, 27, 29, or 31 from selector valve 51. The selected tank serves as a separator so that the air rises to the top of the tank and the liquid falls to the bottom. Common air manifold 80 causes an air pressure reduction above the liquid of all five tanks as air is drawn by air supply means 61 through conduit 70 connected to common air return manifold 80. In this way the air which has been separated by rising to the top of a tank is returned and recirculated through applicator 21 and pressure build-up in the tank is prevented. First valve 71 is positioned in air return line 70 and is kept open during both the toning and purging operations. Valve 71 is closed only temporarily when loading paper onto a drum or take-up spool before writing or toning begins. By closing valve 71 the suction of air supply means creates a partial vacuum at port 90 which is connected by means not shown to a drum or take-up spool also not shown.

A second air valve 72 is positioned to short circuit the hose supply line 55 to the hose return line 57 in order to provide a low resistance return path for purged fluids without passing through the liquid pump 53 which would restrict the high velocity flow. This short circuit path also permits the liquid pump to remain running during fluid purging so that residual liquid within liquid pump 53 is purged and returned to selector valve 51 through open valve 72. At the same time, opening third air valve 73 provides high velocity air for forward purging of the running liquid pump 53 through valve 72. Opening third valve 73 also provides high velocity purge air for reverse purging of the liquid supply line connecting the input of liquid pump 53 to selector valve 51. The selector valve 51 connects with selected toner supply line 33, 35, 37, or 39 or with wash fluid supply line 40. In this way the selected fluid supply line, the selector valve, the liquid pump input line, the liquid pump, the applicator supply line 57 and the applicator itself are all effectively purged of liquid. Fourth air valve 74 and fifth air valve 75 are opened as described above to supply high velocity purging air to the applicator 21.

A sixth air valve 76 is positioned in the wash return line 50. When purging wash fluid from the system prior to next color introduction a mixture of dirty wash fluid and air passes from selection valve 51 to air fluid separator 77. The wash return line 50 includes air/liquid separator 77 which serves the same air/liquid separation function as the liquid supply tanks, i.e. the air rises to the top and returns through valve 76 to the wash fluid tank 31 where it is again drawn into common manifold 80 and returned to air supply means 61 for recirculation. At the same time the dirty wash fluid collects in the bottom of separator 77 where it is slowly drawn through liquid cleaning cartridge 79 which removes the colored particles from the wash fluid so that clean wash fluid is returned to wash fluid tank 31 through return line 50. In this way the wash fluid is kept pure and clean so that liquid color cross contamination is prevented and image quality maintained. Liquid cleaning cartridge 79 retains the colored particles and is periodically replaced during system maintenance. Valve 76 is closed only for the replacement of cartridge 79 for the purpose of forcing liquid out of the cartridge by means of air pressure and into the wash fluid supply tank 31. This results in a relatively dry cartridge for safe and clean disposal. Normally, purging of liquid from cleaning cartridge 79 by closing valve 76 results in color contamination of the wash fluid in tank 31. It is usually necessary to clean tank 31 when replacing cartridge 79. If wash fluid tank 31 is a replaceable bottle the procedure is easier since no cleaning is required.

Following is a sequential description of the procedures required to make a full color print and leave the system in a clean condition:

First, with liquid pump 53 off, valves 72, 73, 74, and 75 closed, air supply means 61 running and selector valve connected to black toner supply tank 23 by means of toner pickup line 33 and return line 43, close normally open air valve 71 to create a partial vacuum at port 90 so as to load paper onto a drum or onto take-up spool 13. After paper is attached open air valve 71 so as to start airflow through toner applicator 21. If needed for paper retention on spool 13 or a drum, air return line 70 may be of smaller diameter than air supply line 63 so as to provide a slight flow restriction and keep a slight vacuum at port 90. As an example, line 70 may have an internal diameter of one-half inch for this purpose. Valve 76 remains open during the entire printing process.

After paper is loaded and air recirculation started begin forward paper motion towards spool 13 and, at the same time begin writing by applying writing voltages to scanning writing head 20 and start liquid pump 53 so as to deliver black toner to applicator 21 before latent image bearing paper reaches applicator. Normally the paper web is stationary during one head scan transit and then the paper is advanced before beginning the next head "scan". During this first "black" pass, the latent image is created at scanning write head 20 and rendered visible by toning at applicator 21. Air supplied by means of conduit 67 from conduit 65 and air supply means 61 passes over a "knife" edge within the applicator so as to remove excess liquid from the paper web. Such an "air knife" is described in U.S. Pat. No. 4,870,462 to G.F. Day. This air knife liquid removal results in a mixture of black toner and air exiting applicator 21 through return line 57 to selector valve 51 and thence to black toner tank 23. As described above, the air is separated from the liquid and returned by means of common manifold 80 for continuous recirculation. After completion of the black imaging pass open valves 72, 73, 74 and 75 while running liquid pump 53 so as to thoroughly purge the black toner from the entire system as described above. Valves 74 and 75 may be operated sequentially as described above so as to more thoroughly purge internal passages in applicator 21. Begin paper re-wind in preparation for the next, "cyan" color pass. Select wash fluid supply line 40 and wash fluid return line 50 using selector valve 51 then close air valves 72, 73, 74, and 75 after paper re-wind is complete so as to thoroughly wash the common volume with clean wash fluid and thus remove all black toner particles from the common or shared volume. As described previously the dirty wash fluid is collected in air/liquid separator 77 for cleaning by means of cleaning cartridge 79. After washing is complete, re-open air valves 72–75 so as to purge the residual wash fluid from the common volume and return it to the wash fluid tank 31. Begin the cyan write pass by scanning the write head 20 and applying write voltage to create the cyan latent image on the paper web 15. Before the cyan latent image reaches the applicator 21 close air valves 72–75 so as to supply cyan toner to applicator 21 in order to render visible the cyan image. Note that the liquid pump 53 and the air supply means 61 remain running during the entire process.

Repeat the above process for cyan, magenta, and yellow imaging. After purging of the wash fluid following the final, yellow imaging pass the entire system is clean and the system may be shut down by first turning off the liquid pump 53 then the air supply means 61. Note that the liquid pump 53 is never operated unless the air supply means is in operation. A principal reason for this is that toner and wash fluid containment in the applicator is by means of an air curtain completely surrounding the liquid in the area of the applicator in contact with the paper.

In FIG. 2, a full-width toner applicator 21 may be seen to have an elongated structure with a first end 81 and a second end 83. Fresh toner enters applicator 21 via entry port 85 at end 81 and travels across the full width of the applicator via an internal cross-channel, not shown, which is connected to port 85. A longitudinal slit delivers the fresh toner to the upper face of the applicator where it tends to spread out and contact the latent image bearing paper web. At the same time air is delivered to the applicator via entry ports 87 and 89 where the air serves to prevent leakage of liquid toner around the upper edges of the applicator as well as to remove by means of an air knife the excess liquid from the paper web. The details of this air containment and liquid removal will be described in more detail later. The air ports 87 and 89 always supply air to the applicator in contrast to ports 91 and 93 which deliver air to the applicator only when valves 74 and 75 are opened for liquid purging. Valve 72 is opened if either valve 74 or 75 (or both) is opened. The result is that residual liquids are driven by the air jet to the left and out of the applicator and, via return line 57 back to the selector valve 51 from where they are returned to the corresponding liquid tank. Gravity then separates the liquid from the air within the tank 23, 25, 27, 29, or 31 so that the air may return to the air supply means via the common manifold 80, open valve 71 and air return line 70. There is always an abundant supply of air which is adequate to supply several needs simultaneously although separate opening of the air valves 74 and 75 will allow somewhat more thorough liquid purging of the internal channels of the applicator.

Port 95 at the left end 81 of the applicator 21 serves as a drain means during toning while purging valves 74 and 75 are closed. A mixture of air and used toner from the air knife, which is disposed along an upper edge of the applicator, is delivered to port 95 and thence to return line 57, selector valve block 51 and then to the corresponding liquid tank wherein the liquid is stored and the air separated for recirculation as described above.

The longitudinal channels in the applicator which are connected to ports 87 and 89 remain dry and free of liquids at all times so long as air pressure is supplied via these ports while the liquid pump 53 is running. Provided the air supply means 61 is started before starting the liquid pump 53 and allowed to operate until a short time after the liquid pump 53 is shut down, the channels connected to ports 87 and 89 will remain in a dry state and not require liquid purging. For this reason the left end of the applicator in FIG. 2 shows no purging ports corresponding to air supply ports 87 and 89 on the right side of the applicator. There are no valves in the air supply lines connecting air supply means 61 with air supply ports 87 and 89. Such valves, if existent and closed, might allow liquids to enter the channels corresponding to ports 87 and 89 and this would enlarge the purging task unnecessarily.

Toner in the toner supply channel connected to port 85 will be blown during purging, i.e. when valves 72 and 74 are open, backwards in the direction opposed to its normal flow via open valve 72 into return line 57. At the same time valve 73 is opened thus supplying abundant jet air to toner supply line 82 at junction 84. From junction 84 the air moves both left and right, i.e. in the normal toner flow direction to the left and opposed to normal toner flow to the right. To the left the jet air assists in purging all liquid from the still running liquid dump 53 and, via open valve 72 the air assists the return of this purges liquid to return line 57 and back via selector valve block 51 to the correct supply tank. Jet air moves from junction 84 in opposition to the normal toner flow direction and pushes the liquid backward through the toner supply line 82 to the selector valve block 51 to a selected liquid supply line 33, 35, 37, 39, or 40 backwards to the correct tank. Thus, during liquid purging a mixture of air and liquid enters the selected tank through both the selected toner supply line and the selected return line 43, 45, 47, 49, or 50. Thus all purged fluids will wind up in the corresponding liquid tank via selector valve block 51 whether they return via the corresponding supply line or the air/liquid return line. By this arrangement of valves and lines, the entire common volume including the liquid pump is air jet purged so as to minimize fluid mixing and allow a single full-width applicator to be used for all colors.

After substantially all the liquid toner of a given color is collected by air jet purging in the corresponding toner tank the selector valve is actuated so as to select wash fluid then the air valves 72, 73, 74, and 75 are closed allowing liquid pump to draw wash fluid from wash fluid tank 31 via wash fluid supply line 40, selector valve block 51, and liquid supply line 82 to liquid pump 53. From pump 53 the wash fluid is forced by pressure through the same paths as was the preceding toner during toning of the latent image. The wash fluid picks up the small amount of residual toner remaining after air jet purging and returns the colored particles via drain line 57, selector valve 51, and wash the fluid return line to wash fluid separator 77. The air knife operates just as with toner application so that the wash fluid returning via drain line 57 is mixed with air. The air is separate by separator 77 from the "dirty" wash fluid and returns to wash fluid tank 31 via open valve 76 and return line 50. The dirty wash fluid then passes through the wash fluid cleaner cartridge 79 wherein the colored particles are removed and the cleaned liquid returned via return line 50 to the wash fluid tank 31. In this way the wash fluid remains substantially free of all colored particles.

After substantially all colored particles are removed from the common volume and collected in separator 77, air valves 72–75 are opened, with liquid pump 53 and air supply means 61 still running, so as to purge the now clean wash fluid from the entire common volume and return it to the wash fluid tank 31 via supply line 40 and return line 50 just as described above for a colored toner. In this way unnecessary dilution of toners by wash fluid is prevented when the valves 72–75 are closed for introduction of the next toner color. The wash fluid cleaning cartridge 79 has no effect on the clean wash fluid which passes through it as a result of wash fluid purging. An added benefit of this air jet purging apparatus is that air valves 73, 74 and 75 can be selectively opened during the wash cycle to assist pickup of colored toner particles by the wash fluid. Air moves at much higher velocity than the liquid wash fluid alone, thus a mixture of air and wash fluid can scour the inner surfaces of the applicator channels even more thoroughly than wash fluid alone, which moves more slowly in the absence of air. It is believed that what happens is that the high speed jet air picks up droplets of wash fluid and accelerates them to very high velocity where they have an effect similar to sand-blasting and are extremely effective in cleaning the inner surfaces of the toner applicator, supply lines, drain lines, and the liquid pump. Thus the high speed jet air is seen to have multiple and compound benefits in cleaning the system and preventing color cross contamination. Image quality is preserved and toner disposal problems minimized.

Figure 3A:
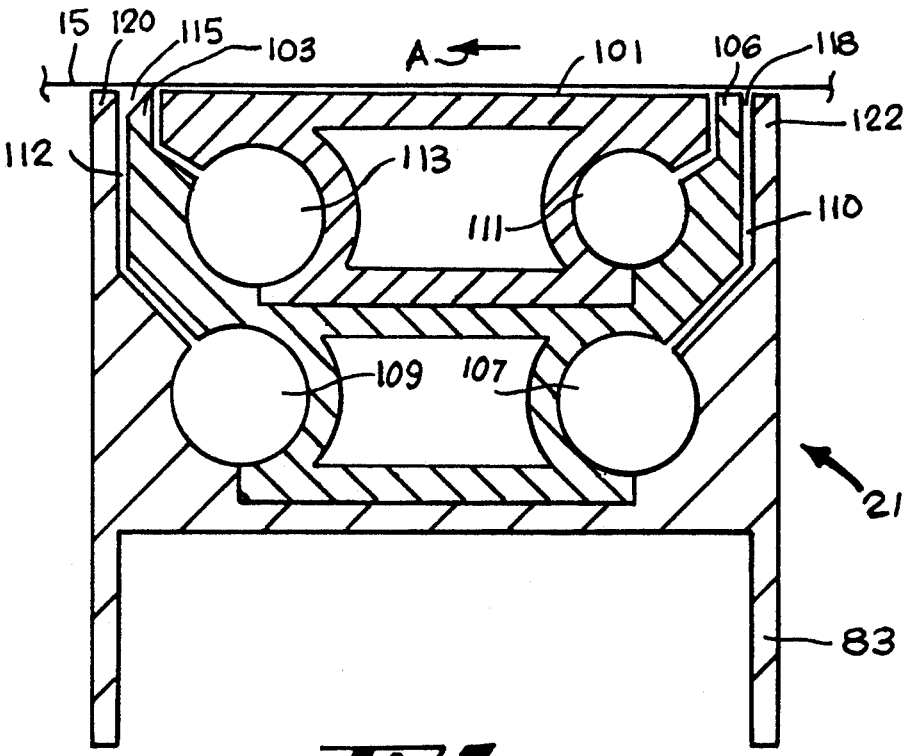
FIGS. 3*a* and 3*b* are side sectional views of toner heads for use with the piping plan shown in FIG. 2.

In FIG. 3*a* is seen a more detailed cross-sectional view of the toner applicator 21 of FIG. 2. The view shown in FIG. 3*a* is taken from the right end 83 which is hidden in FIG. 2. Air from air supply means 61, shown in FIG. 2, is supplied to cross channels 107 and 109 from air inlet ports 87 and 89 of FIG. 2. Air flows upward through the slits 110 and 112 as shown until it reaches the upper surface of the applicator which contacts the paper web 15. The air pressure at the topmost ends 118 and 115 of delivery slits 110 and 112 is greater than the liquid pressures in "wet" applicator areas lying between the topmost ends 118 and 115 so as to fully contain the liquids and so as to prevent leakage of the liquids beyond the long edges of the applicator 21. At the near and far "narrow" ends of the applicator U-shaped grooves open at the top, not shown, are provided in the upper surface of the ends of the applicator in such a manner as to connect topmost ends 118 and 115 with each other at both the near and the far ends of the applicator. These two grooves together with the topmost ends 118 and 115 of the supply slits 110 and 112 form a rectangular curtain or "moat" as seen from above, of high pressure air which completely surrounds the wet, exposed portions of the applicator preventing liquid leakage beyond the long edges or the narrow ends of the applicator. The paper web is positioned in direct planar contact with the upper surfaces of the applicator so as to substantially prevent air leakage and loss except for the air which escapes inward over the knife edge 103 and into drain channel 113. This air moat eliminates the need of a bucket to catch any spilled toner and provides for a completely closed toning system in which the toner is fully captured even when in contact with the moving paper web. This prevents evaporation of liquid toner and wash fluid, thus reducing organic hydrocarbon vapors in the vicinity of the printer. An added benefit is that the closed toning system is easily self-cleaned by the wash fluid so that manual cleaning is not required. The air pressure is automatically monitored to insure that it is always greater than the maximum liquid pressure thereby insuring no liquid leakage. Should the air pressure, for any reason, fall to the same level as the liquid pressure the liquid pump 53, as seen in FIGS. 1 and 2, is automatically shut down and a system fault indicated to the operator.

A planar backing member, not shown, above, i.e. behind, the paper holds the paper flat and causes it to resist the pressure of the air and the liquids. The paper remains flat and effectively seals the fluids below wherever it contacts facing surfaces of the applicator. Although slight air leakage occurs due to paper roughness and parts tolerances this is not a significant air loss and the air pressure provides a leak free seal for the liquids which are at reduced pressure. Outer contacting surfaces 120 and 122 which are aligned with contacting surface 106 also bear against the paper and substantially prevent air loss beyond the long edges of applicator 21.

Fresh toner is supplied to cross channel 111 of FIG. 3*a* by port 85 of FIG. 2 by liquid pump 53. This fresh toner moves upward through the slit as shown until it reaches the paper web 15. The high pressure air of topmost end 118 prevents the toner from moving to the right so that it is forced to travel to the left towards topmost end 115. The broad upper surface 101 which actually contacts the paper web 15 substantially prevents air from topmost end 118 from leaking into the wet area to the left of upper surface 106. A small amount of air may leak into the wet zone where it does no harm. While the toner travels from the delivery slit which communicates with channel 111 towards air knife 103 the actual toning process takes place with a portion of the charged toner particles adhering to the charged latent image. For this purpose the broad upper surface 101 of the applicator is spaced away from the paper, i.e. it is recessed slightly below the plane of upper contacting surfaces 106, 120 and 122. The resulting space or gap between the image surface of the paper and the broad surface 101 is preferably in the range 0.003 inches to 0.010 inches and ideally 0.004 to 0.005 inches. Smaller spacings tend to impede fluid flow such that insufficient toner is available for complete toning whereas larger spacings cause a slowing of the toning process resulting in similarly incomplete toning.

The flowing toner or wash fluid approaches the knife edge 103 which is spaced away from the paper surface by a spacing similar to the spacing of broad surface 101 away from the paper, i.e. by 0.003 to 0.010 inches and preferably by 0.004 to 0.005 inches. Between broad surface 101 and knife edge 103 a slit is positioned so as to allow fluids to freely descend to drain channel 113 which is connected to drain port 95 and drain line 57 of FIG. 2. This slit is preferably wider than 0.010 inches in thickness so as to not impede air flow, liquid flow, or a mixed flow downward to channel 113. Similarly drain channel 113, drain port 95, drain line 57, the internal drain passages of selector block 51 and the selected return line 43, 45, 47, 49, or 50 are all large enough, preferably with an internal diameter greater than 0.5 inches, so as to allow free unimpeded fluid flow all the way back to the selected supply tank 23, 25, 27, 29, or 31. In this manner the total fluid pressure at the top of the slit which separates broad surface 101 from knife edge 103 is kept very low, preferably below 0.1 pounds per square inch. The air supply means 61 of FIG. 2 preferably is capable of supplying more than 5 cubic feet of air per minute of air at a pressure greater than 0.2 pounds per square foot so as to insure air pressure no less than 0.2 pounds per square inch at the topmost end 115 of air supply slit 112. All the connecting lines and passages which deliver air to topmost end 115 are preferably greater than 0.5 inches in internal diameter so as to assure a sufficient air supply so as to provide no less than 0.2 pounds per square inch of air pressure at topmost end 115.

This air at relatively high pressure moves to the right between the knife edge and the paper at a velocity preferably greater than 100 feet per second and both the liquid arriving from the right and the air arriving from the left of the drain slit then descend downward to drain channel 113. At the same time, the fluid shear force of the air passing between the knife edge and the paper insures that substantially all of the liquid is removed from the paper resulting in only a very thin film of liquid being carried out by the moving paper web. With the paper web moving to the left, i.e. parallel to the toner flow in the gap separating the paper from broad surface 101 at a speed of about 2 inches per second this carried out film of liquid is preferably less than 0.00004 inches in thickness.

Figure 3B:
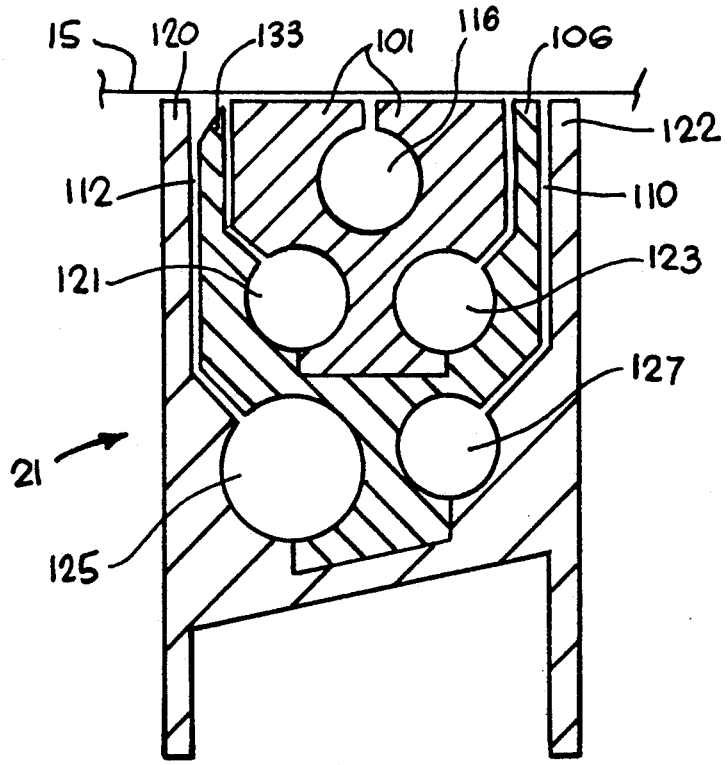

FIG. 3*b* shows an alternative embodiment of applicator 21. While the functioning is essentially similar to the applicator of FIG. 3*a*, the toner or wash fluid flows in the gap between the broad surface 101 and the paper in both directions from a centrally located supply slit connected to supply channel 116. A portion of the liquid flow moves "upstream", i.e. against the leftward paper web motion, and downward through a slit as shown into drain channel 123. Contacting surface 106 substantially prevents air flow from air supply slit from mixing with this liquid. As a result the drain slit 110 and the drain channel 123 can be smaller than the air/liquid drain slit 112 and channel 121 if desired since they do not have to carry a large amount of air. In the gap separating the broad surface 101 from the paper the toning process and particle adhesion to the latent charge image occurs in substantially the same manner whether the toner stream moves with the paper motion to the left or against the paper motion to the right. The toner or wash fluid stream moving to the left towards the knife edge 133 encounters the opposed air stream and is driven downward to second drain channel 121 in a manner essentially the same as described for FIG. 3*a*. Drain channel 123 and drain channel 121 connect together at a point, not shown, external to the applicator so that a mixture of liquid and air feeds into the common drain line 57 and then into the selector valve 51, shown in FIGS. 1 and 2.

The applicator embodiment shown in FIG. 3*b* has an advantage in that the liquid stream is divided into two separate flows in the "toning" gap so that the individual flows are lessened. This results in a reduced impedance to liquid flow thus reducing the maximum liquid back pressure and permitting a closer spacing of the broad surface 101 away from the paper web. The result of the closer spacing is improved toning efficiency and a reduction in overall size for this "bi-flow" embodiment. Preferably the gap thickness which separates broad surface 101 from the paper is in the range 0.003 to 0.004 inches or about 20 percent less than the "uni-flow" embodiment of FIG. 3*a*. It is believed that the toning effectiveness of the FIG. 3*b* embodiment is improved by more than 50 percent compared to the FIG. 3*a* embodiment. It should be realized that even more liquid supply channels and slits could be provided along with additional drain slits to further enhance toning efficiency. Such a more complex toning structure would be useful for very high paper web speeds. On completion of a toning pass air valves are opened in order to purge residual toner from the entire common volume including channels 116, 121, and 123 within the applicator. It should be understood that an additional line and air valve is required for the FIG. 3*b* embodiment as an additional drain line must be purged. If yet more supply channels 125 and 127 are used, such as for very high paper web speed, an additional jet air purge line and valve is required for each additional channel. After toner purging the selector valve 51 of FIGS. 1 and 2 is used to connect the wash fluid supply and return lines and all purging air jet valves are closed so as to allow the liquid pump to draw wash fluid and thoroughly wash the common volume. Then the wash fluid is air jet purged as previously described and the process repeated for each color.

If this invention is used for higher speed toning involving additional supply channels and drain channels it may be necessary to use more powerful air supply means and a larger liquid pump. It is believed that this invention may thus be extended to extremely high paper web speeds almost without limit.

The velocity of fluids due to the pumping action of liquid pump 53 of FIGS. 1 and 2 is generally less than about 3 feet per second in the pipes and channels of the toning system. On the other hand the air velocity produced by air supply means 61 in the air lines and channels is typically in the range 50 to 100 feet per second. If the air is directed by valves into typically smaller liquid supply lines for purposes of air jet purging the air velocity is even greater, typically in the range 100 to 150 feet per second or more. This large velocity difference provides a unique cleaning opportunity for the air jet purging system of this invention.

Normally, as in U.S. Pat. No. 4,987,429 to Finley et. al., wash fluid cleaning of the common volume is accomplished by circulating wash fluid by itself through the common volume. Now, however, with the introduction of a high velocity air jet from the air supply means 61, a new cleaning method is possible. While the wash fluid is circulating air valves may be opened so as to simultaneously introduce jet air into the common volume. By proper control, i.e. by rapid opening and closing of the jet air purge valves an arbitrary ratio of air and wash fluid may be achieved as desired. If the purge valves are opened for a large fraction of the time but not continuously, a stream of jet air with a small amount of intermixed wash fluid may be produced. The result is a high speed stream of air with droplets of intermixed wash fluid which becomes at least partially atomized by the jet air. The small liquid droplets are accelerated to very high speed by the mass of air and thereby act as a very effective scouring agent for removing residual colored toner and leaving much cleaner surfaces after washing than would be possible by liquid washing by itself. The result is yet a further reduction in cross color contamination, better image quality preservation after extended usage, and reduced need for disposal of spent, contaminated toners. For best results, of course, the air jet liquid purging of both wash fluid and toners is to be combined with scouring by an appropriate combined liquid and air cleaning during the wash cycle. The volume ratio of air to wash fluid may be as high as 1000:1 or even higher.

I claim:

1. A color system for producing a developed image on a surface of a recording medium having an electrostatic latent image comprising, a toner applicator in communication with a recording medium surface supporting an electrostatic latent image to be toned, a single pump selectively connected to a plurality of toner supply vessels, each toner supply vessel holding toner of a different color, the pump connected to feed said toner applicator with toner of a selected color, one color at a time over common passages, and means having an air outlet for directing high velocity air into said common passages with positive pressure for expelling liquid therefrom.

2. The system of claim 1 further comprising an air inlet for said high velocity air pump, the air inlet connected to a recording medium holder having air channels, the air inlet communicating negative air pressure via said air channels to said recording medium thereby causing the recording medium to adhere to said holder.

3. The system of claim 1 further comprising valve means for isolating said air blower from said common passages.

4. The system of claim 1 wherein the recording medium surface is mounted on a drum having air channels connected to the air inlet communicating negative air pressure to said recording medium.

5. The system of claim 3 wherein the toner applicator extends across the width of the latent image.

6. The system of claim 1 wherein the recording medium surface is a web.

7. The system of claim 2 wherein said air inlet is connected to a manifold shared by said plurality of toner supply vessels.

8. The system of claim 1 wherein the plurality of toner supply vessels are connected to a selector valve and the common passages extend between the selector valve and said pump and between the pump and the toner applicator.

9. A toner system for producing an image on a surface of a recording medium, means for electrostatically charging a recording medium, a toner applicator means for applying liquid toner to the recording medium, a single pump means for supplying toner from a plurality of toner supply vessels to the toner applicator means through common passages forming a loop from the toner supply vessels to the toner applicator means and back to the supply vessels where excess toner is collected, and air supply means having an air outlet for directing high velocity air into said common passages for purging toner therefrom into said supply vessels.

10. The system of claim 9 wherein said air blower has an air inlet connected to a support for said recording medium whereby the recording medium is held to said support by suction from the air inlet.

11. The system of claim 9 wherein said pump means and said air outlet of the air blower are both connected to said common passages.

12. A color system for producing a developed image on a surface of a recording medium comprising, means for moving a recording medium surface relative to an electrostatic image charging head, a toner applicator in fluid communication with said surface and having about a width spanning the entire image to be formed, pump means connected to a plurality of different toner supply vessels and a wash fluid vessel by means of a selector for forcing toner and wash fluid from said vessels into the toner applicator, a common passageway extending from the selector to the toner applicator and extending through the pump, the common passageway having a return portion from the toner applicator to the supply vessels and the wash fluid vessel, and air supply means for directing an air jet into the common passageway through one or more valves capable of isolating the air supply means from the common passageway.

13. The system of claim 12 wherein said recording medium has a support with apertures extending therethrough, the recording medium positioned above said apertures and said air supply means has an air inlet and an outlet, the inlet creating a suction applied to said apertures communicating suction to the recording medium, thereby holding the medium in place.

14. The apparatus of claim 12 wherein said means for moving a recording medium is a pair of spaced apart rolls.

* * * * *